United States Patent [19]

Short

[11] 4,158,339

[45] Jun. 19, 1979

[54] NARROW GAUGE CUT PILE LOOPER APPARATUS

[75] Inventor: Hoyt E. Short, Chattanooga, Tenn.

[73] Assignee: Tuftco Corporation, Chattanooga, Tenn.

[21] Appl. No.: 917,863

[22] Filed: Jun. 22, 1978

[51] Int. Cl.[2] ..... D05C 15/00

[52] U.S. Cl. ..... 112/79 R

[58] Field of Search ..... 112/79 A, 79 R

[56] References Cited

U.S. PATENT DOCUMENTS

| | | | |
|---|---|---|---|
| 3,064,600 | 11/1962 | Card | 112/79 R |
| 3,635,177 | 1/1972 | Gable et al. | 112/79 R |
| 3,780,678 | 12/1973 | Short | 112/79 A |
| 4,003,321 | 1/1977 | Card | 112/79 R |

*Primary Examiner*—Ronald Feldbaum

*Attorney, Agent, or Firm*—Harrington A. Lackey

[57] ABSTRACT

A narrow gauge, cut pile looper apparatus for a multiple-needle tufting machine, preferably having staggered needles, comprising a transverse hook bar having staggered front and rear slots in the front and rear faces of the hook bar and longitudinal top slots, a top slot being in alignment with each of the corresponding front slots and rear slots, for receiving a corresponding front or rear looper.

7 Claims, 3 Drawing Figures

NARROW GAUGE CUT PILE LOOPER APPARATUS

BACKGROUND OF THE INVENTION

This invention relates to a multiple-needle tufting machine, and more particularly to a cut pile looper apparatus for a narrow gauge tufting machine.

Conventional hook bars for multiple-needle tufting machines are long bars extending transversely of the machine below the needles and the base fabric. A conventional cut pile hook bar has uniformly spaced slots in its front face for receiving the loopers which cooperate with the needles to form loops in the yarns carried by the needles. For a narrow gauge multiple-needle tufting machine, the slots in the front face of the hook bar must be formed close together. The closeness of the spacing of the rear looper slots is limited by the thinness of the walls between the slots.

One solution to spacing the looper slots close together for narrow gauge tufting machines is disclosed in the prior U.S. Pat. No. 3,635,177, issued to Larry P. Gable et al for "NARROW GAUGE HOOK BAR FOR TUFTING MACHINE" on Jan. 18, 1972. The Gable patent discloses a hook bar having uniformly spaced, but staggered, looper slots formed alternately in the front and rear faces of the hook bar. Thus, the staggered front and rear slots receive two transverse rows of staggered hooks or loopers for cooperation with corresponding staggered needles. However, the hook bar disclosed in the Gable patent was primarily designed for a looper apparatus for forming narrow gauge loop pile.

SUMMARY OF THE INVENTION

It is therefore an object of this invention to provide in a narrow gauge, multiple-needle tufting machine an improved hook bar having alternately staggered front and rear looper slots for receiving cut pile loopers or hooks.

In order to provide a cut pile looper apparatus designed to cooperate with staggered needles for very narrow gauges, in the order of 1/16 inch gauge, the hooks or loopers must be made of relatively thin material, yet must have bills of sufficient length projecting from the body portions of the loopers supported in the hook bar to cross and cooperate with the corresponding staggered needles.

Accordingly, it is one feature of this invention to form in the top portion of the hook bar a plurality of transversely spaced longitudinal top slots. Each of the top slots is in longitudinal alignment with and intercepts a rear slot. Thus, the body portion of a rear slot fits longitudinally within a corresponding top slot, so that the opposing walls of the top slot rigidly hold the thin body portion in a reinforced position in the hook bar to minimize flexing and vibration of the rear looper during its rapid reciprocation and cooperation with its corresponding needle for forming loops. The fitting of the body portion of the rear looper within a top slot also provides rigid support for the looper as it continually cooperates with its corresponding knife for cutting the yarns to form cut pile tufts.

In a preferred form of the invention, top slots are also provided in alignment with and intercepting each of the front slots to firmly support and hold the body portions of the front loopers, even though the front loopers are closer to their corresponding needles than the rear loopers are to their corresponding needles.

DESCRIPTION OF THE PREFERRED EMBODIMENT

Figures 1, 2, 3:
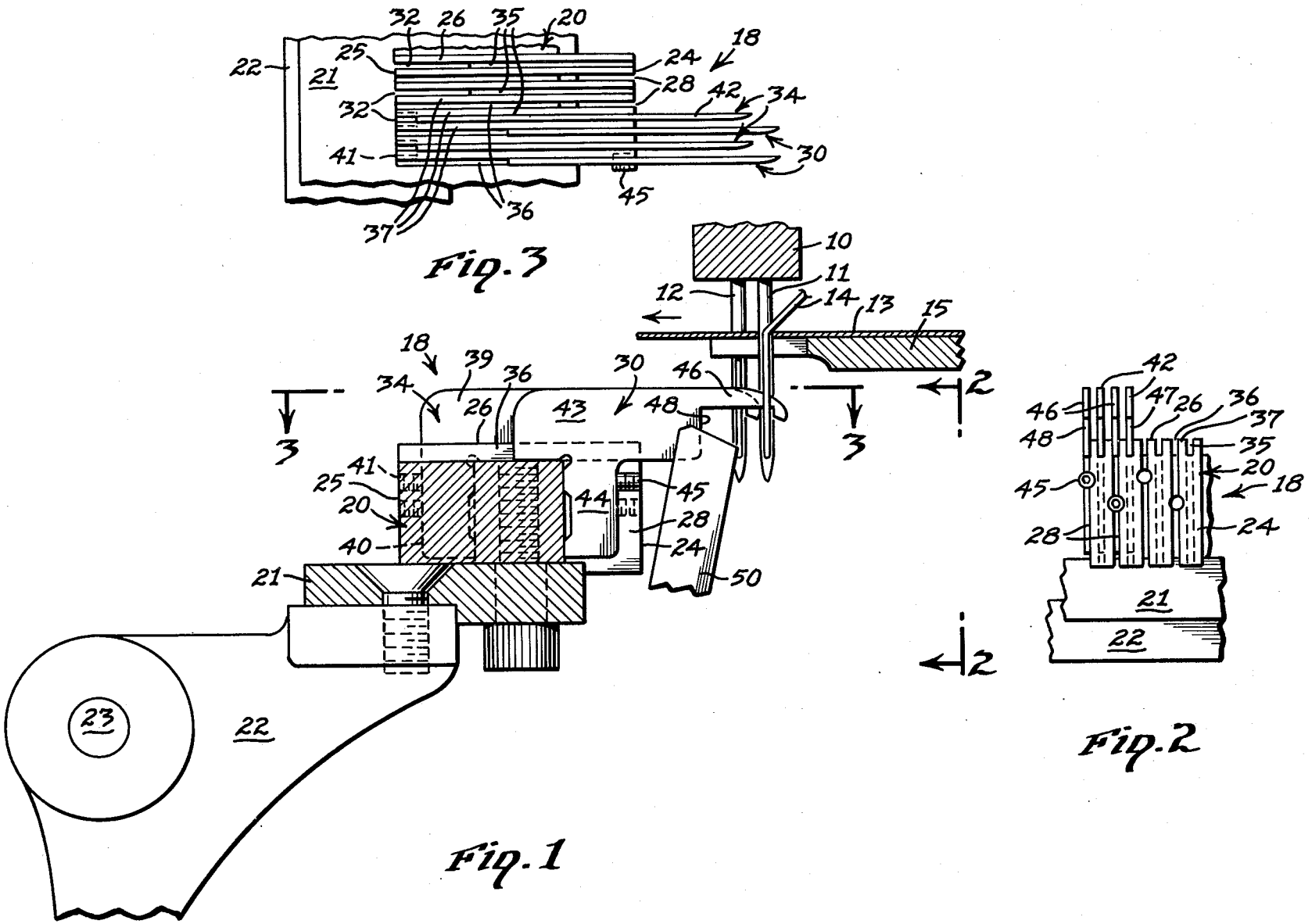
FIG. 1 is a fragmentary, sectional elevation taken longitudinally through a portion of a narrow-gauge, staggered-needle tufting machine incorporating a cut pile looper apparatus made in accordance with this invention, and disclosing the needles and loopers in operative loop-forming position.
FIG. 2 is a fragmentary, front elevation of the looper apparatus, taken along the line 2—2 of FIG. 1.
FIG. 3 is a fragmentary, top plan view of the looper apparatus, taken along the line 3—3 of FIG. 1.

Referring now to the drawings in more detail, FIG. 1 discloses a transverse needle bar 10 in a conventional multiple-needle tufting machine supporting a first row of uniformly spaced front needles 11 and a second row of uniformly spaced rear needles 12 offset preferably midway between the front needles 11, to provide a uniform, narrow gauge staggered needle tufting machine. The needle bar is vertically reciprocated by conventional means, not shown, to cause the front and rear needles 11 and 12 to move between an upper position above the base fabric 13 to a lower position penetrating the base fabric 13 so that the needles will carry yarns, such as yarn 14, through the base fabric 13 to form loops of tufting therein. The base fabric 13 is supported upon a needle plate 15 for movement, by means not shown, in the direction of the arrow of FIG. 1, that is longitudinally from front-to-rear through the machine.

The looper apparatus 18 which cooperates with the needles 11 and 12 includes a transverse hook bar 20 fixed upon a transverse hook bar plate 21, which is in turn supported upon a plurality of rocker arms 22 journaled on a rock shaft, not shown, and driven by conventional means connected at link pins 23.

The hook bar 20 has a front face 24, a rear face 25 and a top surface or face 26.

Formed in the front face 24 are a plurality of uniformly spaced vertical front slots 28. The thickness of the front slots 28 is substantially the same as the thickness of the portion of the corresponding front looper 30 to be received therein.

In a similar manner, a plurality of uniformly spaced rear slots 32 are formed through the rear face 25 of the hook bar 20. However, the rear vertical slots 32 are evenly staggered with respect to the front slots 28, as best disclosed in FIG. 3. Each rear slot 42 is of a width substantially the same as the thickness of the portion of a rear looper 34 to be received therein.

Each of the rear slots 32 is in alignment with and intercepts a first top slot 35 which is straight and extends longitudinally the full breadth of the hook bar 20 and through the front face 24 of the hook bar 20.

In like manner, a second set of top slots 36 extend straight and longitudinally through the top wall 26 and the front face 24 of the hook bar 20. Each top slot 36 is in alignment with and intercepts each of the front slots 28.

In a preferred form of the invention, each of the top slots 35 and 36 is separated by a substantially rigid supporting wall 37.

Each of the rear loopers 34 is of a substantially uniform, relatively thin steel material and includes a body portion 39 adapted to be received in the first top slot 35 substantially snugly. A shank portion 40 depending from the body portion 39 is also snugly received within a rear slot 32 and held in the rear slot 32 by means of the set screws 41. Projecting longitudinally forward from the body portion 39 is a relative short bill 42 adapted to cooperate with a rear needle 12.

In a similar manner, the body portion 43 of each looper 30 is also of uniformly thin material adapted to be received in a top slot 36. A shank portion 44 depends from the body portion 43 for reception within a front slot 28, and the shank portion 44 is held in the front slot 28 by a front set screw 45. Projecting longitudinally forward from the body portion 43 is the long bill 46 adapted to cooperate with a corresponding front needle 11 for forming a loop of yarn.

In a preferred form of the invention, each body portion 39 and 43 form transversely aligned throat portions 47 and 48, each of which is adapted to cooperate with one of a plurality of transversely aligned conventional tufting knives 50.

It will be noted in FIG. 1 that the rear portion of the body portion 43 projects behind the shank portion 44 so that it is snugly received within its own top slot or groove 36.

Thus, with each body portion 39 and 43 of each corresponding looper 34 and 30 snugly received throughout a substantial portion of its length within a corresponding top slot 35 and 36, the thin loopers 34 and 30 required for the extremely narrow gauge of the needles 11 and 12 are adequately reinforced and supported for their continuous and rapid reciprocation. Vibration and wear of the thin reciprocating loopers cooperating with the respective needles 11 and 12 and in cutting cooperation with the respective knives 50, are minimized.

It will be apparent from the drawings that the knives 50 must also be thin and of lesser thickness than the corresponding divider walls 37 between the adjacent top slots 35 and 36.

It is also within the scope of the invention to reverse the lengths of the bills 42 and 46 and reverse the stagger of the corresponding needles. Thus, the front bill 46 would be the short bill and the rear bill 42 would be the long bill.

The rear extension of the body portion 43 of the front looper 30 preferably rests solidly in the bottom of the slot 36 to gauge the height setting of the looper 30. Likewise, the lower edge of the body portion 39 rests solidly in the bottom of the top slots 35 to gauge the height of the rear looper 34.

What is claimed is:

1. In a tufting machine having means for supporting a base fabric for longitudinal movement in the feeding direction through said machine, a plurality of transversely spaced reciprocal needles for introducing yarns through said base fabric to form loops, looper apparatus comprising:

(a) a hook bar mounted transversely below the plane of the base fabric for longitudinal reciprocable movement between an operative position below said needles and an inoperative position, (b) said hook bar having a front face and a rear face, (c) transversely spaced front slots in said front face for receiving front loopers, so that each front looper will form a loop in a yarn carried by a first needle in said operative position, (d) transversely spaced rear slots in said rear face for receiving rear loopers, so that each rear looper will form a loop in a yarn carried by a second needle in said operative position, (e) longitudinal top slots formed in the top portion of said hook bar, each top slot intercepting a rear slot and extending through the front face of said hook bar, and (f) each rear looper having a body portion received in a corresponding top slot and a rear slot.

2. The invention according to claim 1 in which said top slots comprise first top slots, longitudinal second top slots formed in the top portion of said hook bar, each second top slot intercepting a front slot and extending through said front face, and each front looper having a body portion adapted to be received in a corresponding second top slot.

3. The invention according to claim 1 in which the body portions of said front and rear loopers have transversely aligned throat portions, a plurality of transversely aligned knives, said knives being adapted to cooperate with corresponding transversely aligned throat portions of said front and rear loopers to form cut pile tufts.

4. The invention according to claim 3 in which said first needles are arranged in a front transverse row and said second needles are arranged in a rear transverse row, said first needles being equally spaced and said second needles being equally spaced and staggered midway between said first needles, to form a uniform gauge, said rear loopers and said front loopers having staggered bills for cooperating with said staggered needles to form loops on said bills.

5. The invention according to claim 2 in which the body portions of said front and rear loopers are each relatively thin and substantially equal in thickness to said corresponding first and second top slots, each pair of adjacent first and second top slots being separated by a relatively rigid longitudinal supporting wall.

6. The invention according to claim 5 further comprising a knife cooperating with each of said front and rear loopers to form cut pile, the thickness of each knife being less than the thickness of each of said corresponding supporting walls.

7. The invention according to claim 2 in which the body portion of each of said front and rear loopers comprises a depending shank portion, the shank portion of said front looper being received in said corresponding front slot, and the depending shank portion of said rear looper being received in its corresponding rear slot.

* * * * *